US010890325B2

(12) United States Patent
Fields et al.

(10) Patent No.: US 10,890,325 B2
(45) Date of Patent: Jan. 12, 2021

(54) FLAME ARRESTOR

(71) Applicant: EATON CORPORATION, Cleveland, OH (US)

(72) Inventors: Thomas James Fields, Grand Rapids, MI (US); Sorin Gavriliuc, Caledonia, MI (US); Aaron Michael Klap, Rockford, MI (US); Peter Robert Foote, Kentwood, MI (US)

(73) Assignee: Eaton Intelligent Power Limited, Dublin (IE)

( * ) Notice: Subject to any disclaimer, the term of this patent is extended or adjusted under 35 U.S.C. 154(b) by 880 days.

(21) Appl. No.: 15/078,645

(22) Filed: Mar. 23, 2016

(65) Prior Publication Data

US 2016/0305653 A1 Oct. 20, 2016

Related U.S. Application Data

(60) Provisional application No. 62/149,143, filed on Apr. 17, 2015.

(51) Int. Cl.

| | |
|---|---|
| ***F23D 14/82*** | (2006.01) |
| ***A62C 4/00*** | (2006.01) |
| ***A62C 4/02*** | (2006.01) |
| *A62C 3/08* | (2006.01) |

(52) U.S. Cl.

CPC ..... *F23D 14/825* (2013.01); *A62C 4/00* (2013.01); *A62C 4/02* (2013.01); *F23D 14/82* (2013.01); *A62C 3/08* (2013.01)

(58) Field of Classification Search

CPC ..... F23D 14/82; F23D 14/825; A62C 4/00; A62C 4/02; A62C 3/08

USPC ..... 431/346; 429/89; 220/88.2

See application file for complete search history.

(56) References Cited

U.S. PATENT DOCUMENTS

| | | | | |
|---|---|---|---|---|
| 1,459,121 | A * | 6/1923 | Van De Wiel | H01M 2/1205 429/89 |
| 1,799,565 | A * | 4/1931 | Patterson | A62C 4/00 220/88.2 |
| 3,356,255 | A * | 12/1967 | Zavertnik et al. | F16L 55/00 220/88.2 |
| 4,072,799 | A | 2/1978 | Leeson et al. | |
| 4,317,868 | A | 3/1982 | Spiegelberg | |
| 4,444,109 | A * | 4/1984 | Gifford, Jr. | A62C 4/00 102/200 |

(Continued)

FOREIGN PATENT DOCUMENTS

| | | | | |
|---|---|---|---|---|
| DE | 2815242 B1 * | 1/1979 | | F23D 14/825 |
| DE | 3135461 A1 * | 1/1983 | | B23K 5/22 |

(Continued)

OTHER PUBLICATIONS

European Search Report 16165224.3, dated Nov. 30, 2016.
European Patent Office; Partial European Search Report issued in counterpart application No. EP16165224.3. dated Aug. 25, 2016.

*Primary Examiner* — Jason Lau
(74) *Attorney, Agent, or Firm* — Fishman Stewart PLLC

(57) ABSTRACT

A flame arrestor including a flame arrestor collar and a flame arrestor plug. The flame arrestor collar includes a flame path that may be defined by one or more modules. The flame arrestor plug may be configured for connection to the flame arrestor collar. Various embodiments of a flame arrestor, including those having venting and/or draining elements or capabilities are also disclosed.

20 Claims, 24 Drawing Sheets

(56) References Cited

U.S. PATENT DOCUMENTS

| | | | | | |
|---|---|---|---|---|---|
| 5,017,129 | A * | 5/1991 | Velie | F23D 14/58 | 126/92 AC |
| 5,203,296 | A * | 4/1993 | Hart | A62C 4/02 | 123/198 D |
| 5,588,822 | A * | 12/1996 | Hayakawa | F23C 15/00 | 431/1 |
| 7,241,137 | B2 * | 7/2007 | Leinemann | A62C 4/02 | 431/328 |
| 2005/0286834 | A1 * | 12/2005 | Aldridge | G02B 6/262 | 385/55 |
| 2011/0008739 | A1 * | 1/2011 | Mungas | F02K 9/566 | 431/346 |
| 2012/0234097 | A1 | 9/2012 | Petersen | | |
| 2014/0030666 | A1 * | 1/2014 | Pryor | B23K 5/22 | 431/346 |
| 2016/0305653 | A1 * | 10/2016 | Fields | F23D 14/82 | |

FOREIGN PATENT DOCUMENTS

| | | | | |
|---|---|---|---|---|
| DE | 3136189 | A1 * | 3/1983 | F23D 14/825 |
| DE | 102007000143 | A1 | 9/2008 | |

* cited by examiner

A-A

C-C

FLAME ARRESTOR

CROSS-REFERENCE TO RELATED APPLICATION

This application claims the benefit of U.S. Provisional Application Ser. No. 62/149,143, filed Apr. 17, 2015, the disclosure of which is hereby incorporated herein by reference in its entirety.

TECHNICAL FIELD

The present disclosure relates generally to flame arrestors, including modular flame arrestors that may include venting and/or draining capability, and that may be used in a wide range of applications, including aerospace applications.

BACKGROUND

Flame arrestors have been used to prevent explosions from propagating inside or outside of an environment or enclosure. Flame arrestors can be used to help extinguish a flame, for instance, by decreasing the temperature of burning gases below an ignition point. That can be accomplished, for example, by (a) employing a longer flame path between an internal volume and an external environment, or (b) including a multitude of very small cross-sectional area flow paths, with the objective of transferring the heat from the burning gas to the flame arrestor and other components. Most existing flame arrestors are designed for large industrial fuel tanks or pipes. Such flame arrestors may address similar, but not identical needs, with respect to aerospace applications and needs, especially with respect to size and weight considerations. That is, with many aerospace applications, the enclosed empty volume will be intentionally minimized by design. Then a flame arrestor is employed to help prevent an internal flame from propagating outside the enclosure. With conventional aerospace flame arrestors, a long flame path is often used. That is, conventional aerospace designs are commonly based on a labyrinth flame path concept involving a series of cross-drilled holes. However, long flame paths can involve or result in, inter alia, a large and heavy device, large pressure drops, and very small flow cross-section areas can restrict draining capability and/or may be susceptible to plugging (e.g., from fouling and icing).

Among other things, it can be desirable to provide flame arrestors that address some or all of the aforementioned challenges.

SUMMARY

A flame arrestor may include a flame arrestor collar and a flame arrestor plug. The flame arrestor collar may include a flame path that may be defined by one or more modules. The flame arrestor plug may be configured for connection to the flame arrestor collar. Various embodiments of a flame arrestor, including those having venting and/or draining elements or capabilities are also disclosed.

A flame arrestor may include a collar that may be configured to couple the flame arrestor to a portion of an enclosure. The collar may include one or more openings configured to allow gas associated with the enclosure to flow into the flame arrestor. The flame arrestor may also include one or more flame paths disposed within the collar. The one or more flame paths may include one or more grooves configured to transfer gas from one side of the one or more flame paths to another side of the one or more flame paths.

The flame arrestor may also include a plug configured to threadedly connect with the collar. The plug may include one or more exit apertures in communication with the other side of the one or more flame paths. The one or more exit apertures may be configured to allow gas to exit the flame arrestor.

In other aspects, a flame arrestor may include a collar that may include one or more openings that allow gas to flow into the flame arrestor. The flame arrestor may also include a flame path that may include a plurality of flame path modules. Each of the flame path modules may include one or more grooves configured to transfer gas from a first side of the flame path to a second side of the flame path. The flame arrestor may also include a plug configured to threadedly connect with the collar. The plug may include one or more exit apertures in communication with the other side of the flame path. The one or more exit apertures may be configured to allow gas to exit the flame arrestor.

Various aspects of the present disclosure will become apparent to those skilled in the art from the following detailed description of the various embodiments, when read in light of the accompanying drawings.

BRIEF DESCRIPTION OF THE DRAWINGS

Embodiments of the present disclosure will now be described, by way of example, with reference to the accompanying drawings.

DETAILED DESCRIPTION

Reference will now be made in detail to embodiments of the present disclosure, examples of which are described herein and illustrated in the accompanying drawings. While the invention will be described in conjunction with embodiments, it will be understood that they are not intended to limit the invention to these embodiments. On the contrary, the invention is intended to cover alternatives, modifications and equivalents, which may be included within the spirit and scope of the invention as defined by the appended claims.

Figure 1A:
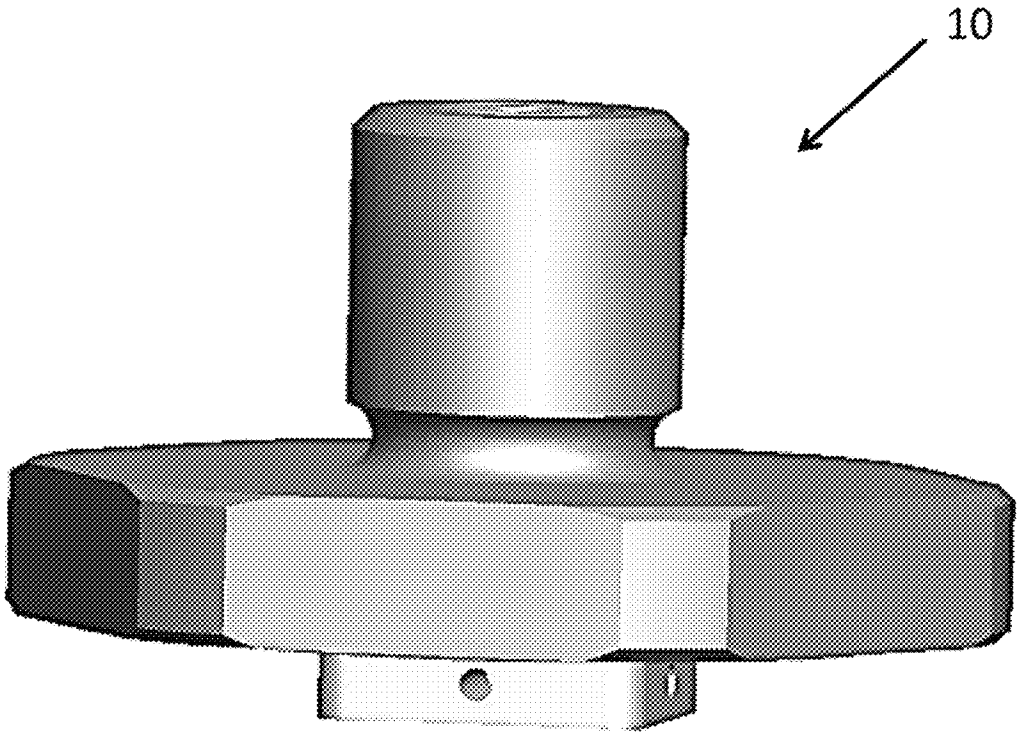
FIG. 1A is side view of a flame arrestor according to an embodiment of the present disclosure.
Figure 1B:
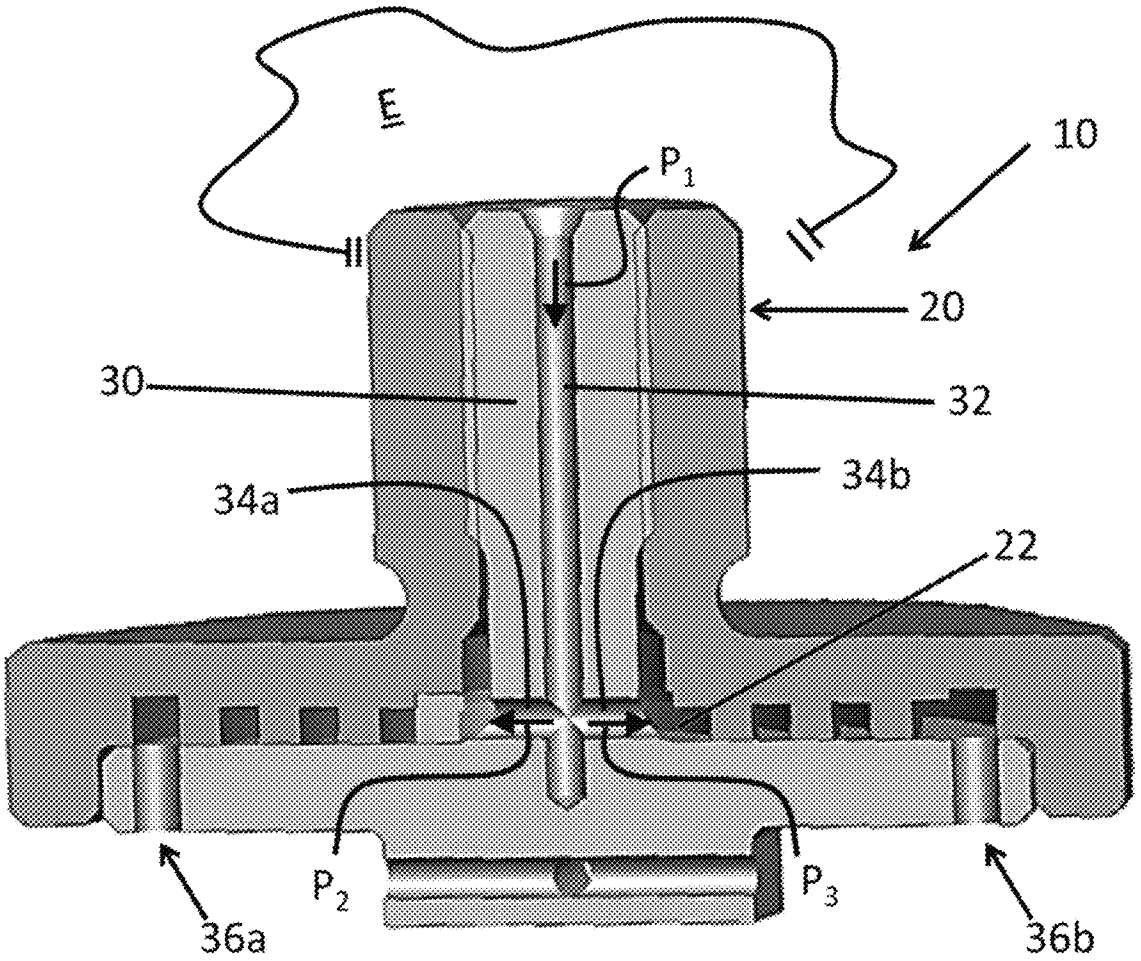
FIG. 1B is side cross-sectional view of the flame arrestor generally illustrated in FIG. 1A.
Figure 2:
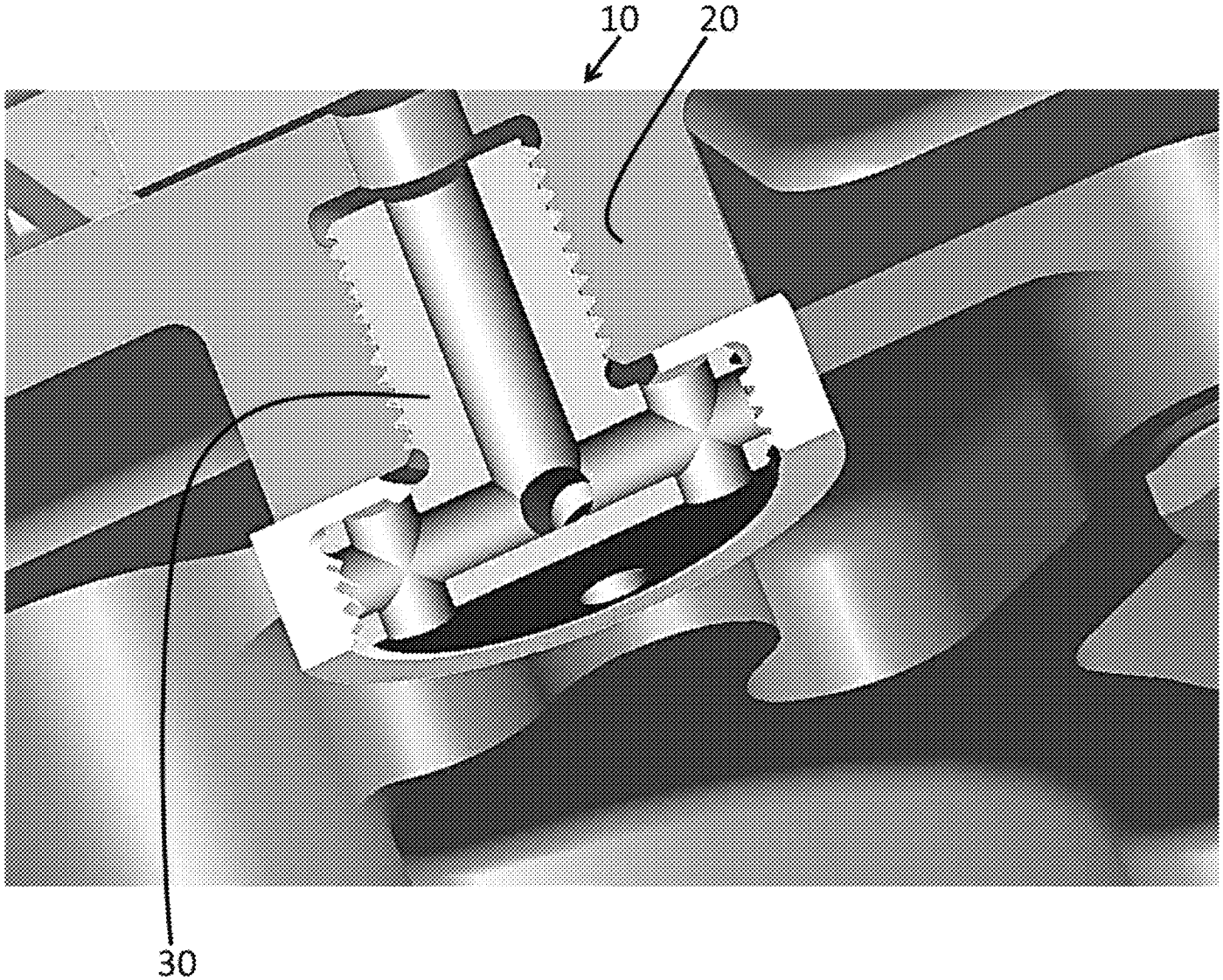
FIG. 2 is a perspective cross-sectional illustration of a flame arrestor according to an embodiment of the present disclosure.

FIG. 1A generally illustrates an embodiment of a flame arrestor 10 according to aspects of the present disclosure. FIG. 1B generally illustrates a cross-sectional view of the flame arrestor 10 shown in FIG. 1A. The flame arrestor 10 may include a flame arrestor collar (or collar) 20 and a flame arrestor plug (or plug) 30, which are generally illustrated in FIGS. 1A and 1B in an assembled configuration. For example, and without limitation, FIG. 2 generally illustrates how a plug 30 may be connected to a collar 20, such as via a threaded connection. In embodiments, flame arrestors may be configured to confine or maintain an internal explosion and may provide a means to drain fluid while stopping a flame from exiting the flame arrestor.

In embodiments a flame arrestor 10, as generally illustrated in FIGS. 1A and 1B, may be referred to as a "single-stage flame arrestor" or a "single-stage plane disk flame arrestor." The flame arrestor 10 may connect to or engage with an enclosure, which is generically shown in FIG. 1B for positional environmental purposes only, as enclosure E. Although, as those of skill in the art will appreciate, the present disclosure is not limited to a particular type or form of associated enclosure. In embodiments, a portion of the flame arrestor 10 may be configured for a suitably solid or firm engagement with a portion of enclosure E. For example, and without limitation, a portion of collar 20 may be configured for a threaded engagement with a portion of an enclosure E. Male threading may be provided on the collar 20 and female threading may be provided in the enclosure E, or vice versa.

In embodiments, a gas from an enclosure (e.g., enclosure E) may enter the flame arrestor 10 and flow downwardly through a one or more openings and/or holes disposed on the collar 20. The gas may flow downwardly through a first substantially vertical path (e.g., path 32) associated with the one or more openings. The gases may generally flow in depicted direction $P_1$. Path 32 may eventually encounter and/or flow into, one or more connected paths. In embodiments, gases flowing from path 32 may flow into depicted radial paths 34*a*, 34*b*, with the flow of gases then generally flowing in depicted directions $P_2$ and $P_3$. The gases flowing through the one or more connected paths, e.g., radial paths 34*a* and 34*b*, may then flow into a flame path 22, which may be formed in the collar 20. In embodiments, a "spiral" or "helical" flame path may be provided in a radially expanded portion of collar 20. The gases entering the flame path may move from an inner diameter to an outer diameter and rotate to holes provided at or about the outer diameter. The "spiral" configuration can extend, and/or optimize or maximize, the flame path associated with the flame arrestor 10 to, inter alia, serve to cool gases that may enter the flame path. Employing an extended, and in this instance "spiral," flame path may permit a comparatively longer flame length, while minimizing the weight and the pressure drop associated with a flame arrestor. Moreover, in embodiments, the ratio of flame path length to the cross section diameter may vary by portion or segment. For example and without limitation, in embodiments, the ratio of flame path length to the cross section diameter may be about 50:1 at an input portion, may be about 60:1 through the grooves, and may be about 70:1 at an output portion. However, the concept is not limited to the forgoing specific ratios and/or variations, and the ratio might, for example and without limitation, be about 200:1 for a harsh environment and may be about 10:1 for a gentle environment.

Eventually, such as generally illustrated in FIG. 1B, the flame path(s) provided in collar 20 may interface or interconnect with one or more exit paths—e.g., exit paths 36*a*, 36*b* provided in plug 30, which may comprise holes or apertures provided in plug 30.

Figure 3A:
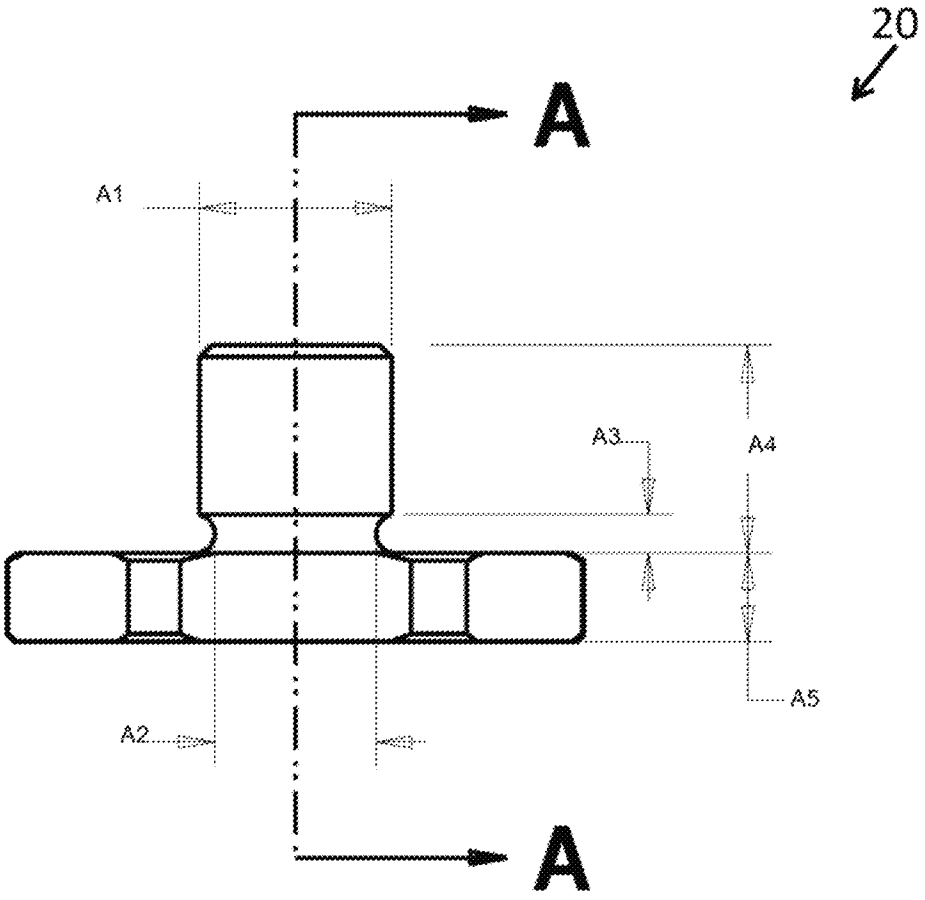
FIG. 3A is a side view of a flame arrestor collar according to an embodiment of the present disclosure.
Figure 3B:
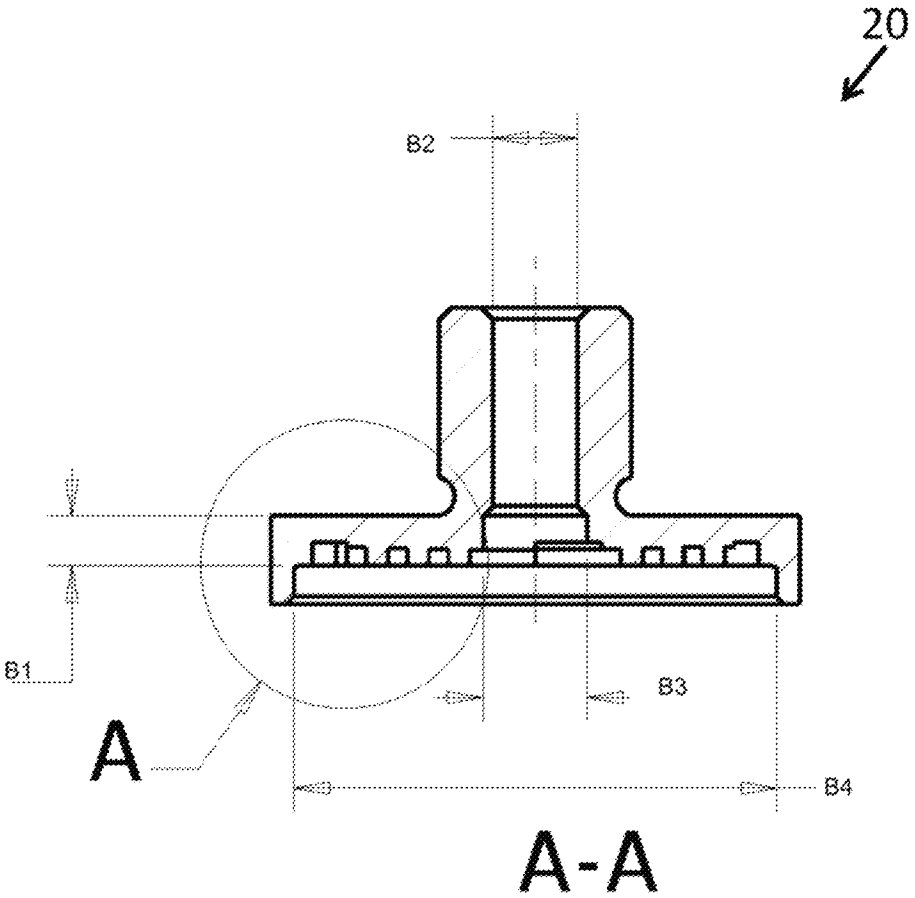
FIG. 3B is a side cross-sectional view of the flame arrestor collar generally illustrated in FIG. 3A.
Figure 3C:
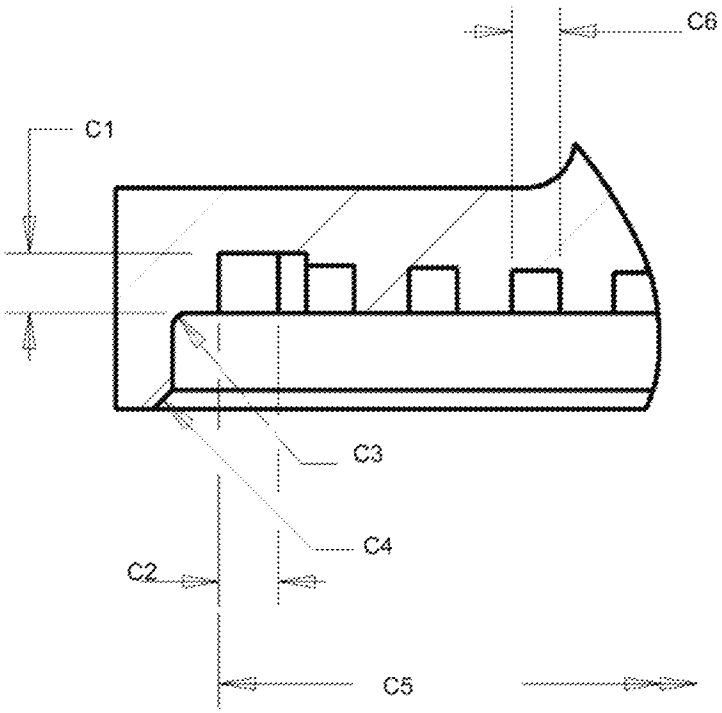
FIG. 3C is an enlarged cross-sectional view of a portion of the flame arrestor collar generally illustrated in FIG. 3B.

FIGS. 3A through 3D generally illustrate an exemplary embodiment of a spiral path-type flame arrestor collar 20. While a number or details and/or dimensions may be included with FIGS. 3A to 3D to help teach concepts, the present disclosure is not limited to such specifics, and those of skill in the art will understand that various other specific sizes, shapes, dimensions, and path configurations may be employed within the spirit and scope of the disclosed concepts. For example and without limitation, and as generally illustrated in FIG. 3A, an embodiment of a collar 20 may include dimensions A1, which may be about 0.500 inches; A2, which may be about 0.420 inches; A3, which may be about 0.10 inches; A4, which may be about 0.540 inches; and A5, which may be about 0.230 inches. Also, for example and without limitation, and as generally illustrated in FIG. 3B, a cross-sectional view of an embodiment of the collar 20 may include dimensions B1, which may be about 0.130 inches; B2, which may be about 0.250 inches; B3, which may be about 0.270 inches; and B4, which may be between about 1.255 and about 1.258 inches. Also, for example and without limitation, FIG. 3C illustrates an enlarged detailed view of a portion of the collar 20 depicted in FIG. 3B. The portion of the collar 20 may, for example and without limitation, include dimension C1, which may range between about 0.057 and about 0.067 inches; C2, which may range between about 0.057 and about 0.067 inches; C3, which range between about 0.010 and about 0.020 inches; C4, which may range between about 0.015 inches at about 40° and about 0.025 inches at about 50; C5, which may range between about 1.155 and about 1.165 inches; and C6, which may range between about 0.045 and about 0.055 inches. In embodiments, the spiral groove, as generally illustrated in FIG. 3C, may be +/−0.100 inches and a pitch break edge may be +/−0.005 inches.

Figure 3D:
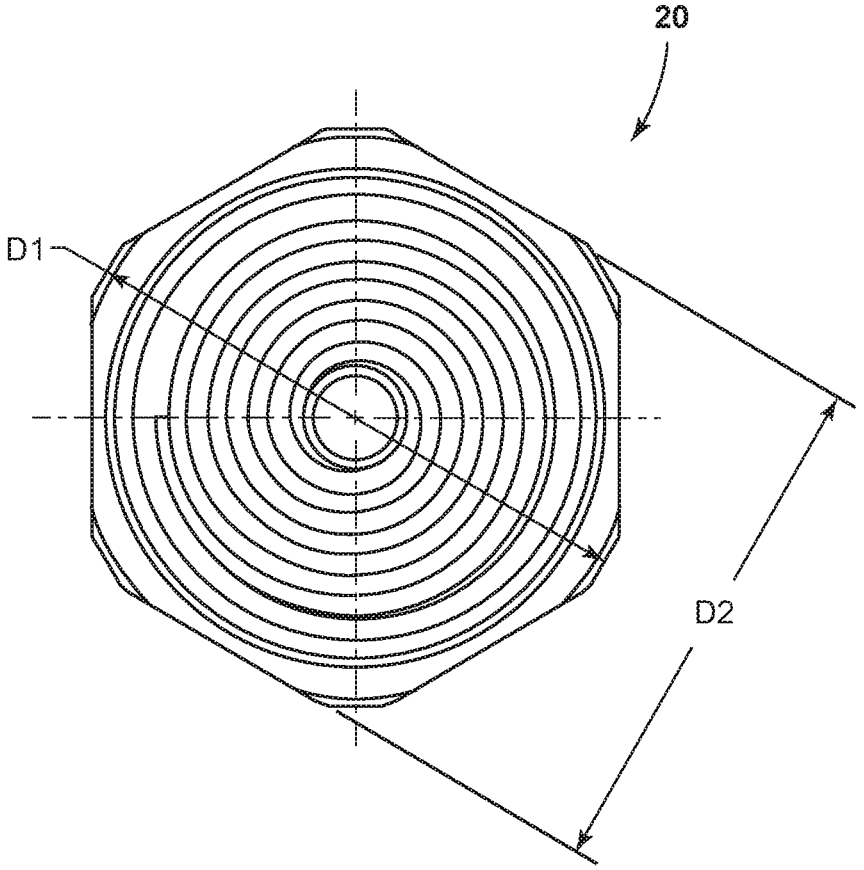
FIG. 3D is a bottom plan view of the flame arrestor collar generally illustrated in FIGS. 3A and 3B.

FIG. 3D generally illustrates a spiral groove wall configuration that forms a spiral flame path. The spiral flame path may, for example and without limitation, include dimensions D1, which may be about 1.500 inches, and D2, which may range between about 1.365 and about 1.376 inches. It is noted that the cross sections may be circular, but it may be simpler to manufacture square cross sections, which may closely emulate the function of circular cross sections. The grooves employed in the various embodiments may serve, inter alia, as a collector. In embodiments, portions of the spiral groove wall, such as shown in FIG. 3D, may be ground to insure a minimum wall thickness—for example and without limitation, a thickness of about 0.030 inches.

For embodiments in which comparatively longer flame paths are desired or employed, there may be design concerns regarding potential blockage. Consequently, with embodiments, including those described herein, multiple (or alternate) flame paths may be included to provide alternative paths—which can help prevent blockage. For example, with the inclusion of multiple flame paths, if one flame path is blocked by debris, dust, grease, dirt, etc., another flame path or flame paths may remain functional.

Figure 4A:
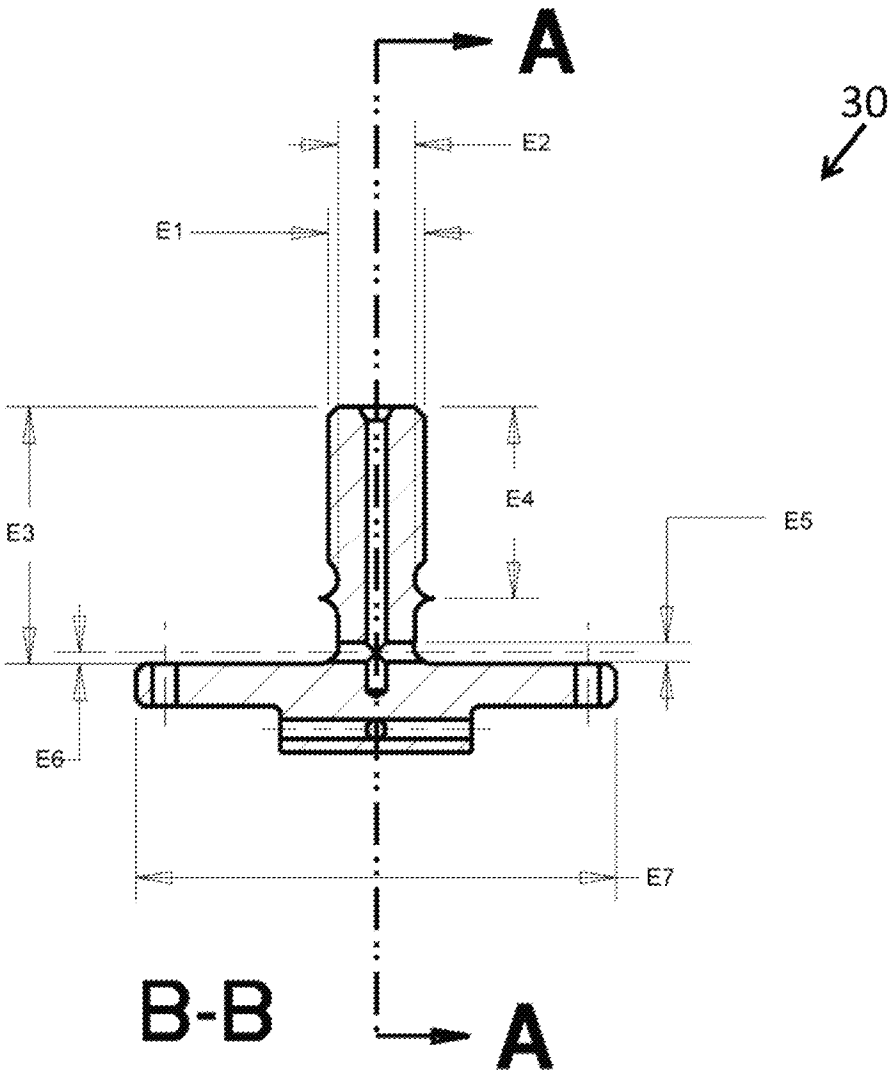
FIG. 4A is a side cross-sectional view of a flame arrestor plug according to an embodiment of the present disclosure, the cross-section as noted in FIG. 4B.
Figure 4B:
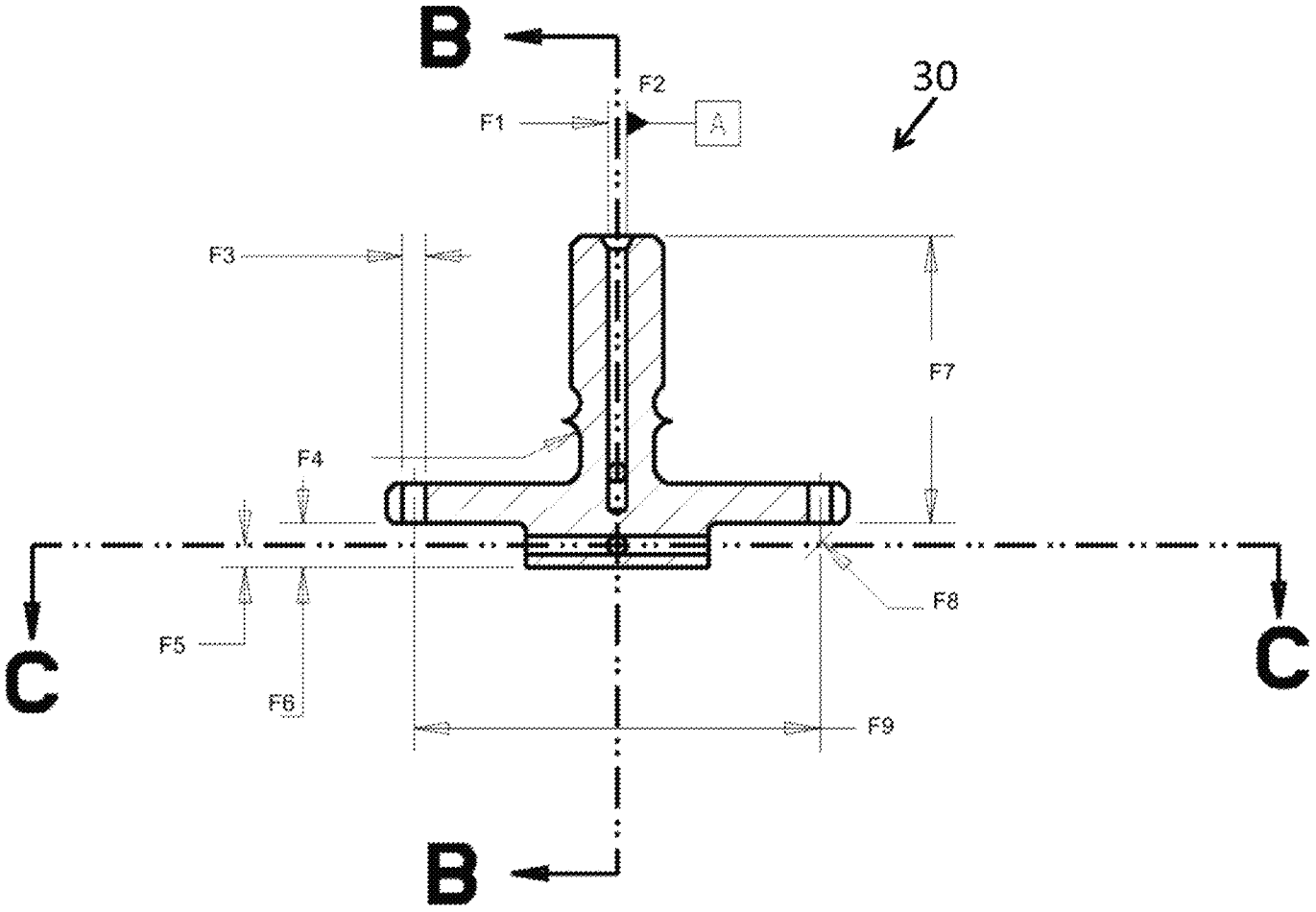
FIG. 4B is a side cross-sectional view of the flame arrestor plug generally illustrated in FIG. 4A.
Figure 4C:
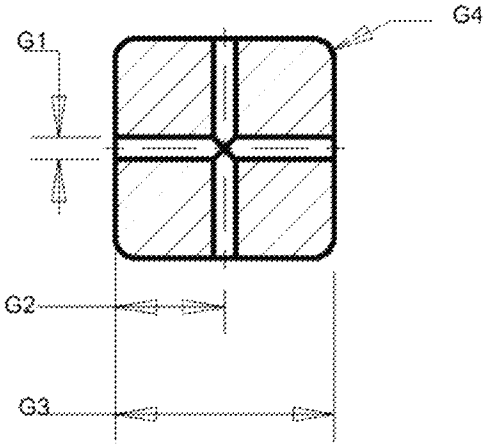
FIG. 4C is a cross-sectional bottom plan view of a portion of the flame arrestor plug generally illustrated in FIG. 4B.

FIGS. 4A through 4C generally illustrate an exemplary embodiment of a spiral path-type flame arrestor plug 30. While a number or details and/or dimensions may be included with FIGS. 4A to 4C or other figures herein to help teach concepts, the present disclosure is not limited to such specifics, and those of skill in the art will understand that various other specific sizes, shapes, dimensions, and path configurations may be employed within the spirit and scope of the disclosed concepts. FIG. 4A illustrates a cross-sectional view of an embodiment of a plug 30, as generally shown in FIG. 4B. The plug 30 may, for example and without limitation, include dimension E1, which may be about 0.250 inches; E2, which may range between about 0.195 and about 0.205 inches; E3, which may be about 0.670 inches; E4, which may be about 0.500 inches; E5, which may range between about 0.045 and about 0.055 inches; E6, which may be about 0.030 inches; and E7, which may range between about 1.247 and about 1.250 inches. In a corresponding manner, FIG. 4B generally illustrates a cross-sectional view of the plug 30 as generally shown in FIG. 4A. The plug 30 may, for example and without limitation, include dimension F1, which may range between about 0.045 and about 0.055 inches; F2, which may represent a length of an aperture disposed within the collar, and may range between about 0.735 and about 0.745 inches; F3, which may, for example, be associated with four equidistantly-spaced holes, having a diameter of between about 0.057 and about 0.067 inches; F4, which may be about 0.050 inches; F5, which may be about 0.060 inches; F6, which may be about 0.120 inches; F7, which may be about 0.780 inches; F8, which may range between about 0.010 inches at about 40° and about 0.030 inches at about 50; and F9, which may be about 1.100 inches. FIG. 4C generally illustrates a cross-sectional bottom plan view of a portion of the flame arrestor plug 30, such as generally illustrated in FIG. 4B. The plug 30 may, for example and without limitation, include dimension G1, which may range between about 0.045 and about 0.055 inches; G2, which may be about 0.248 inches; G3, which may range between about 0.490 and about 0.502 inches; and G4, which may be about 0.05 inches.

Figure 5:
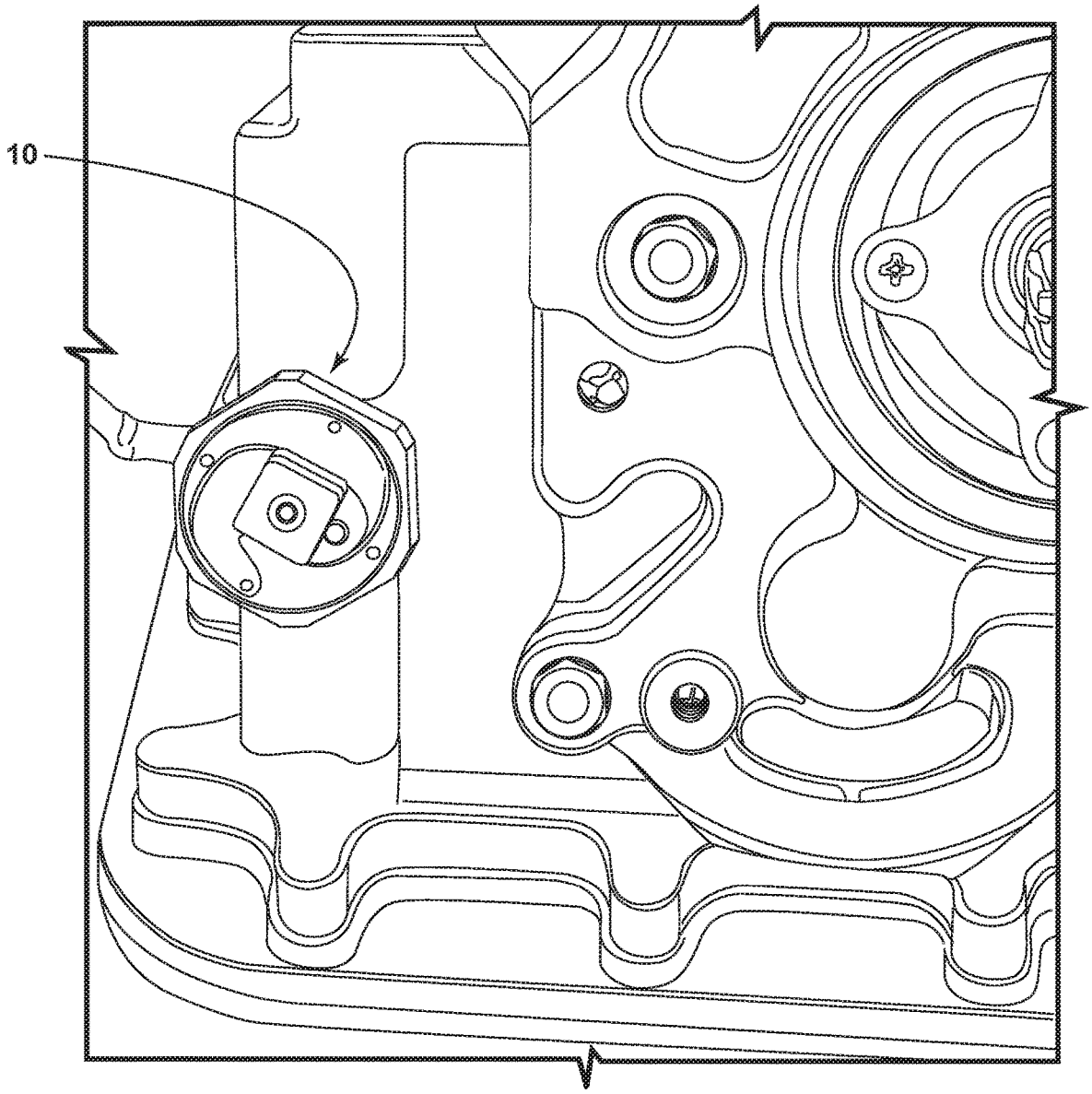
FIG. 5 is an illustration of a "single-stage"-type embodiment of a flame arrestor shown assembled in an environment.
Figure 6:
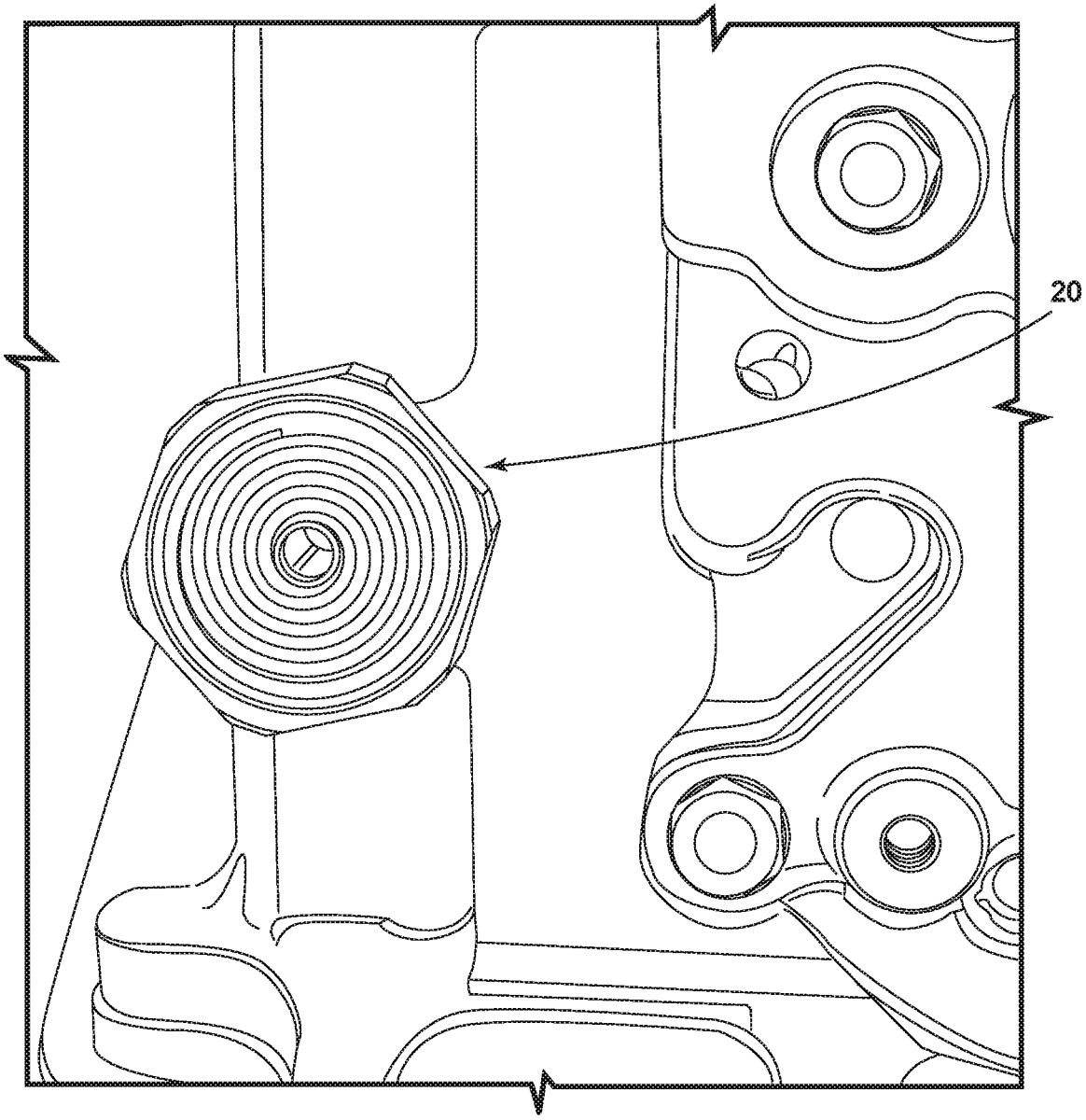
FIG. 6 is an illustration of a single "single-stage"-type embodiment of a flame arrestor of the type depicted in FIG. 5, shown with the flame arrestor plug removed.
Figure 7:
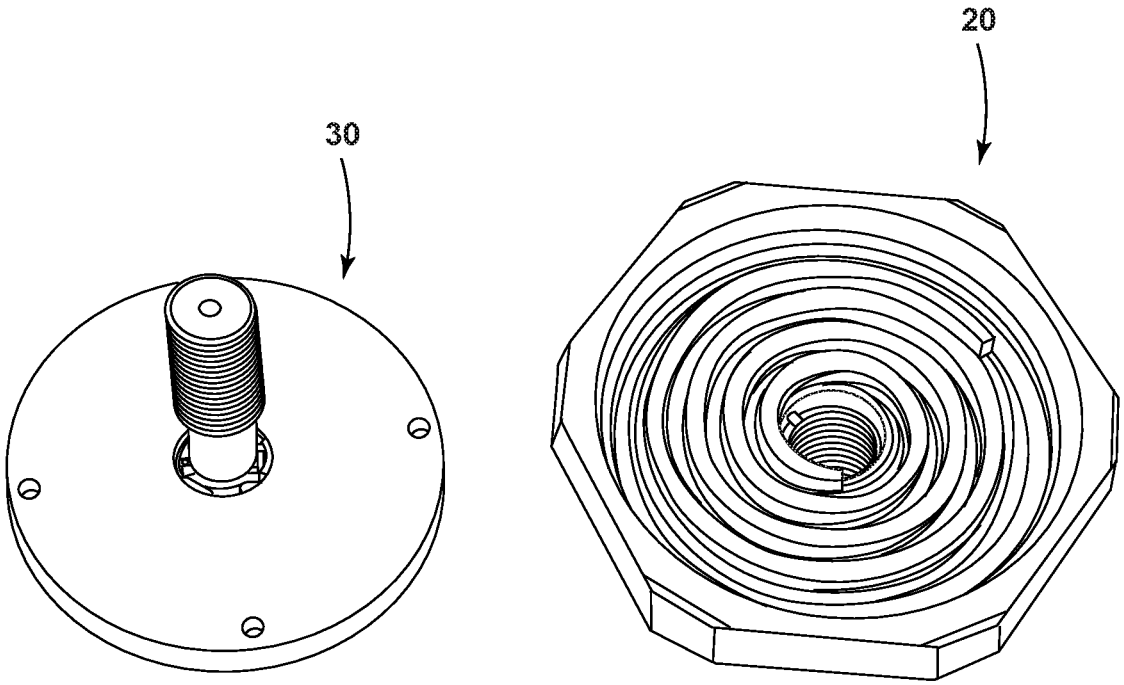
FIG. 7 is an illustration of a flame arrestor plug and flame arrestor collar according to an embodiment of the preset disclosure, shown separated.

FIG. 5 generally illustrates an embodiment of a single-stage flame arrestor 10 shown in an assembled condition and connected to a component. In the illustrated embodiment, an outer hex—which may be turned by a wrench—may be used to lock the parts together. FIG. 6 generally illustrates the flame arrestor of FIG. 5, but with the plug 30 shown removed, which better demonstrates an instance of a spiral or helical flame path. Embodiments of a collar 20 and a plug 30 are separately and generally illustrated in FIG. 7.

Figure 8A:
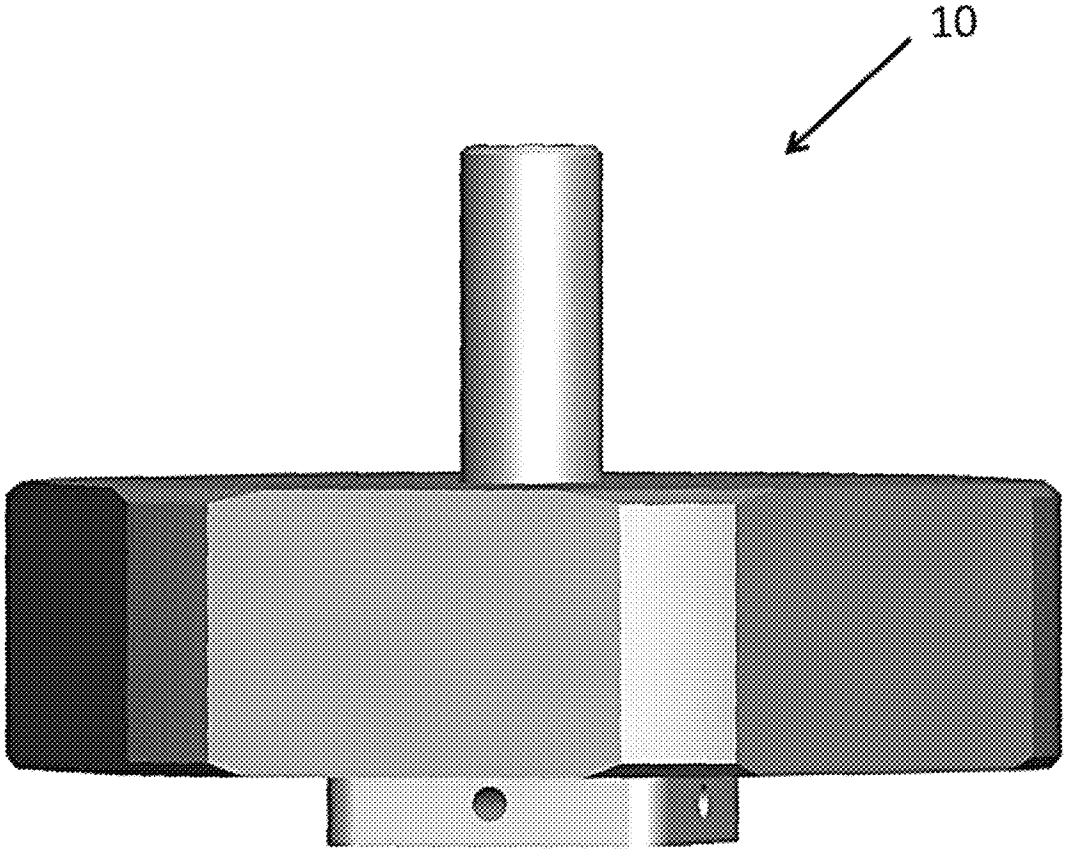
FIG. 8A is side view of a flame arrestor according to another embodiment of the present disclosure.
Figure 8B:
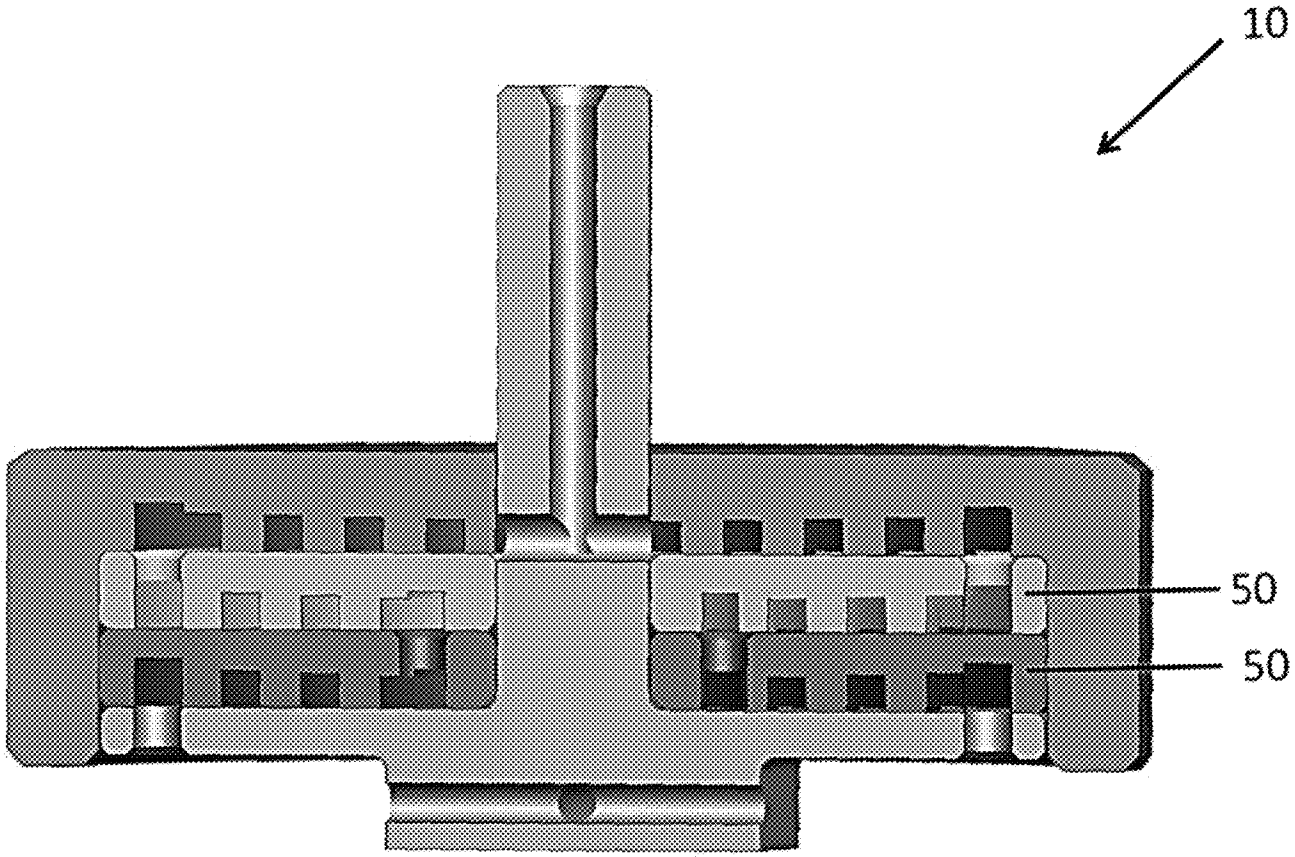
FIG. 8B is side cross-sectional view of the flame arrestor generally illustrated in FIG. 8A.

FIG. 8A generally illustrates another embodiment of a flame arrestor 10 according to aspects of the present disclosure. FIG. 8B generally depicts a cross-sectional view of the flame arrestor 10 shown in FIG. 8A. For example and without limitation, the illustrated embodiment of the flame arrestor 10 shown in FIGS. 8A and 8B may be referred to as a "multiple-stage flame arrestor." This particular embodiment may also employ a spiral or helical flame path configuration. In embodiments, a flame path (e.g., a spiral or helical flame path) may comprise a plurality or series of flame path stages or plates (e.g., flat plates)—which may also be referred to herein as a module 50, or as modules in the plural. In embodiments, the number of modules (such as module(s) 50) may be can be adjusted (e.g., increased or decreased) to achieve a designed or desired flame path for a given design envelope and weight.

In embodiments, all grooves may start from a common, typically circular, collector groove, and may end in a common, typically circular, collector groove. The passage between adjacent modules may comprise passages (e.g., holes or apertures) through the inner or outer collector groove, as needed or desired. In embodiments, the radially outer diameter of a flame path in a first (e.g., top) module or stage may have holes that are configured to transfer gas to corresponding holes associated with an inner radial diameter of a next (e.g., bottom or lower) module or stage. In this manner, the modules 50 may be configured to allow gas to flow from a first side of a flame path to a second side of a flame path. For example and without limitation, the modules 50 may be configured to allow gas to flow from an entry side of a flame path (e.g., a first side and/or a side gas enters the flame path) to an exit side of the flame path (e.g., a second side and/or a side gas exits the flame path). The shape (e.g., cross-sectional shape) of the groove or path may be intentionally or arbitrarily selected, may be round or square or other suitable shape, and may be manufactured on one or both sides of the module. Various manufacturing processes can be used to create the groove(s). For example and without limitation, machining, use of a spiral or helical coil wire between plates, etc. Embodiments of the disclosed concept, which may increase the length of a flame path, may provide for a drop in temperature without causing a substantial pressure drop and/or may provide a reduction in space and weight. Reducing or minimizing pressure drop can be significant because with a long groove if there is a very large pressure drop the release will not be very fast.

It is noted that if modules or stages are not sealed together, configurations may have a minimized gap to create a quasi-seal. For embodiments, such a minimized gap may, for example and without limitation, be about 0.005 inches.

Figure 9A:
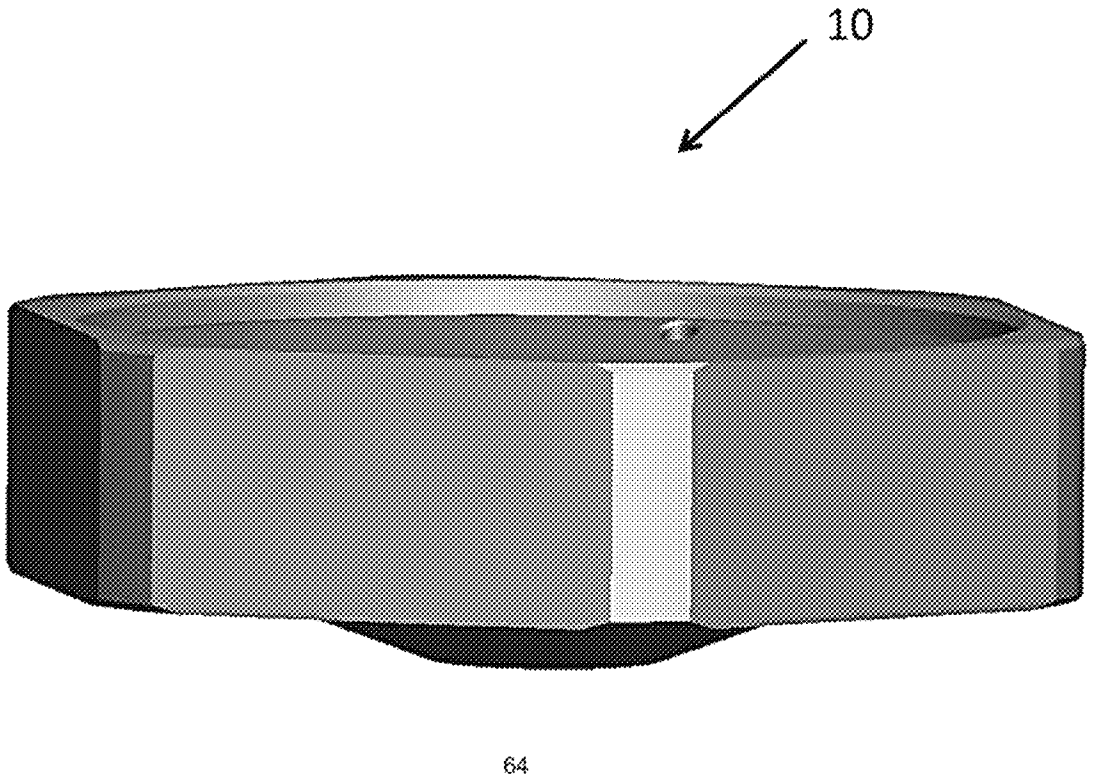
FIG. 9A is side view of a flame arrestor according to another embodiment of the present disclosure.
Figure 9B:
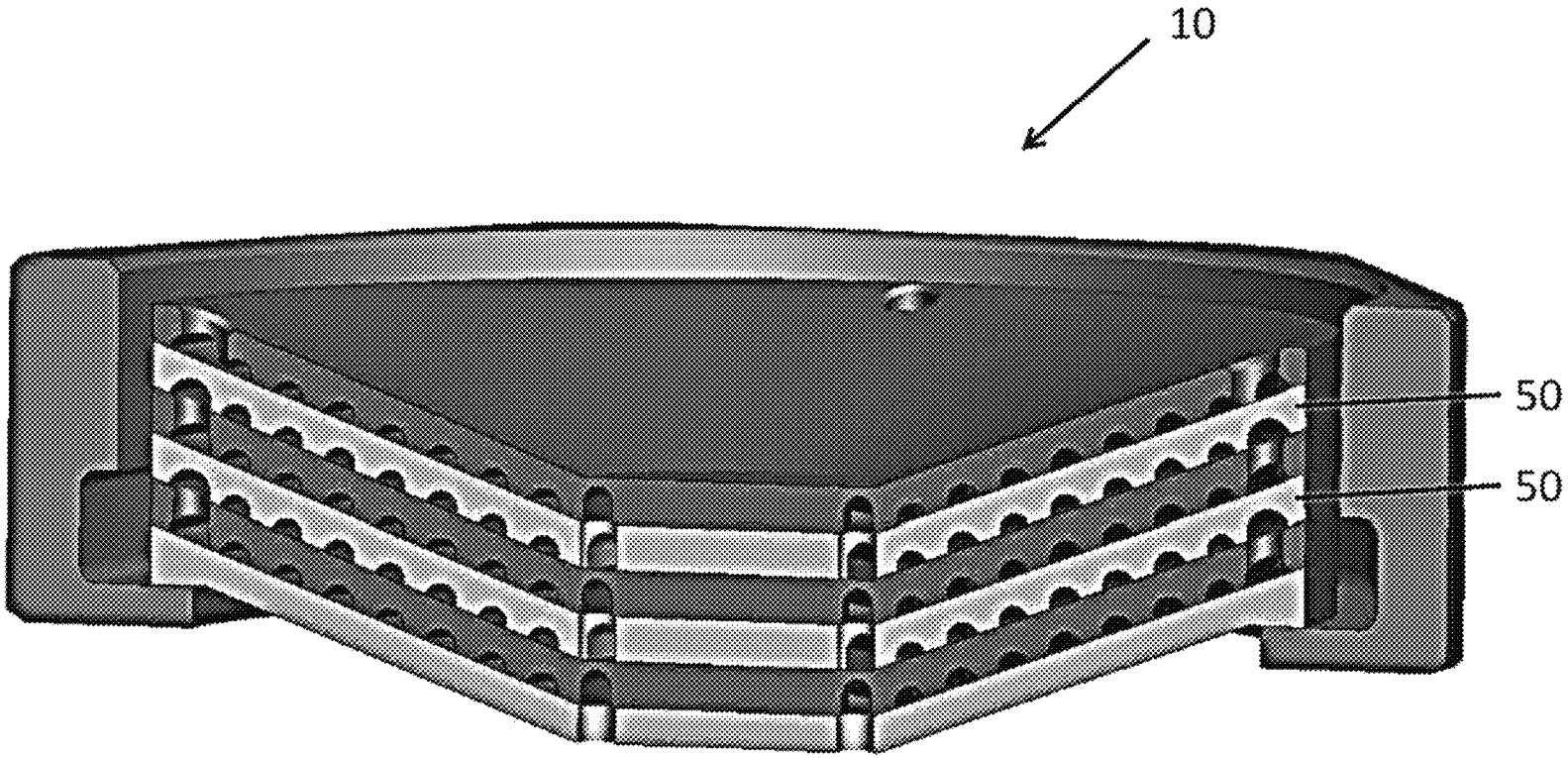
FIG. 9B is side cross-sectional view of the flame arrestor generally illustrated in FIG. 9A.

FIG. 9A generally illustrates a portion of another embodiment of a flame arrestor 10 according to aspects of the present disclosure. FIG. 9B generally depicts a cross-sectional view of the flame arrestor 10 shown in FIG. 9A. For example and without limitation, the illustrated embodiment of the flame arrestor 10 shown in FIGS. 9A and 9B may be referred to as a "multiple-stage flame arrestor" that employs a "conic helical path concept." That is, this particular embodiment may employ a conic flame path configuration.

In the illustrated embodiment, a helical three-dimensional groove may be included in a plate or module (e.g., a conical plate). An intended enclosure may be provided on top of, or above, the flame arrestor. However, if desired an enclosure could be provided on the bottom of, or below, a flame arrestor. Moreover, if needed or desired, a draining feature for the flame arrestor (such as discussed further in this disclosure) may be included on the bottom. In embodiments, the groove may be configured or designed so as not to be square or semi-circular. For example and without limitation, in an embodiment, a plurality of holes (e.g., three holes) may provide a gas flow path to an inner radial diameter in a helical stage/module, then at the next or subsequent stage/module the flow path may be configured to flow from the inner diameter to outer diameter in an upward direction, and then may subsequently/eventually flow out a related number of exit holes in the bottom of a last stage/module.

Figure 10B:
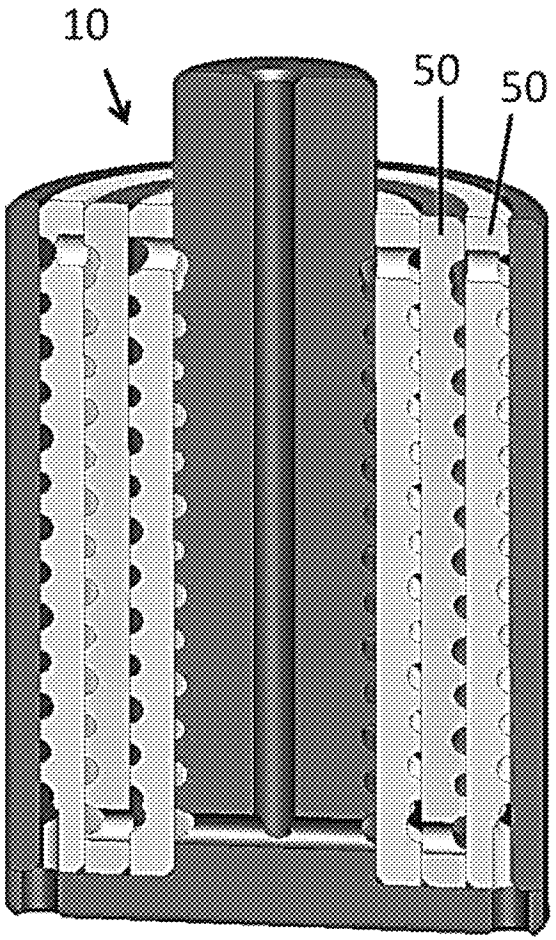
FIG. 10B is side cross-sectional view of the flame arrestor generally illustrated in FIG. 10A.
Figure 10A:
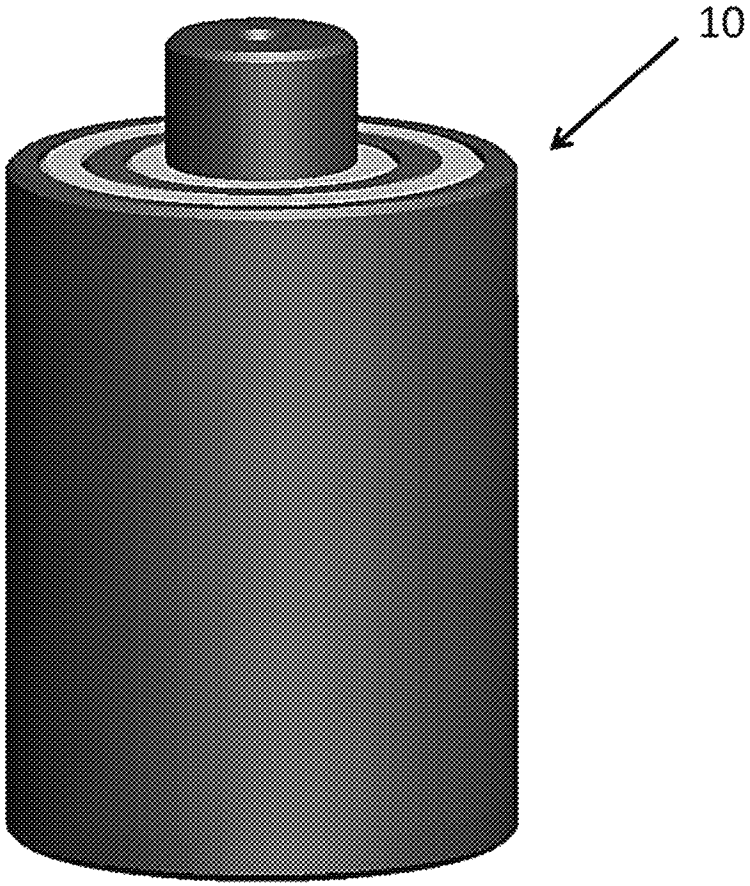
FIG. 10A is side view of a flame arrestor according to another embodiment of the present disclosure.

FIG. 10A generally illustrates a portion of another embodiment of a flame arrestor 10 according to aspects of the present disclosure. FIG. 10B generally depicts a cross-sectional view of the flame arrestor 10 shown in FIG. 10A. For example and without limitation, the illustrated embodiment of the flame arrestor 10 shown in FIGS. 10A and 10B may be referred to as a "multiple-stage flame arrestor" that employs a "cylindrical helical path concept." That is, this particular embodiment may employ a cylindrical helical flame path configuration that may comprise a plurality of cylindrical stages/modules 50. In the illustrated embodiment, a flame path may proceed toward the bottom of the arrestor 10 and may then spiral upwardly. In embodiments, horizontal (radial) holes at the top of a stage may correspond to transfer/entry holes at the top of a next stage/module, which may spiral downwardly until the flame path eventually reaches exit holes (e.g., at an outer diameter at or about the bottom of the arrestor).

Figure 11A:
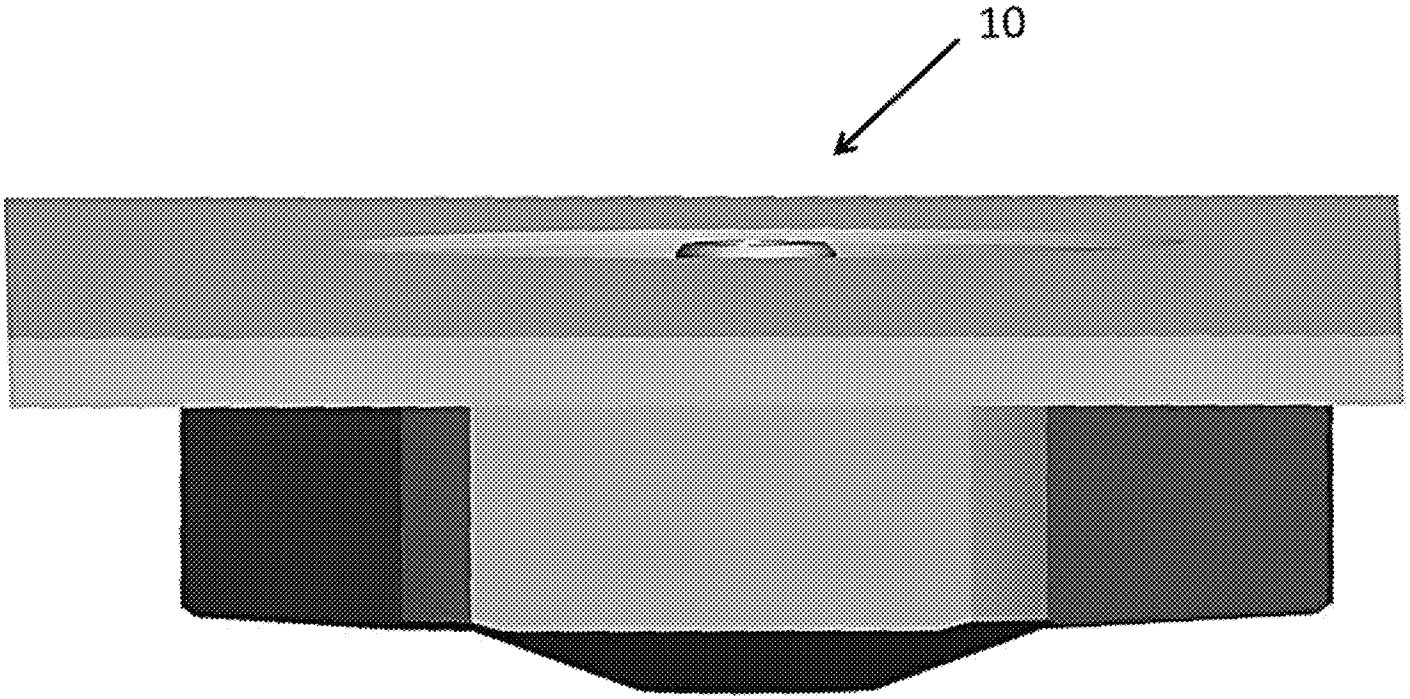
FIG. 11A is side view of a flame arrestor according to another embodiment of the present disclosure.
Figure 11B:
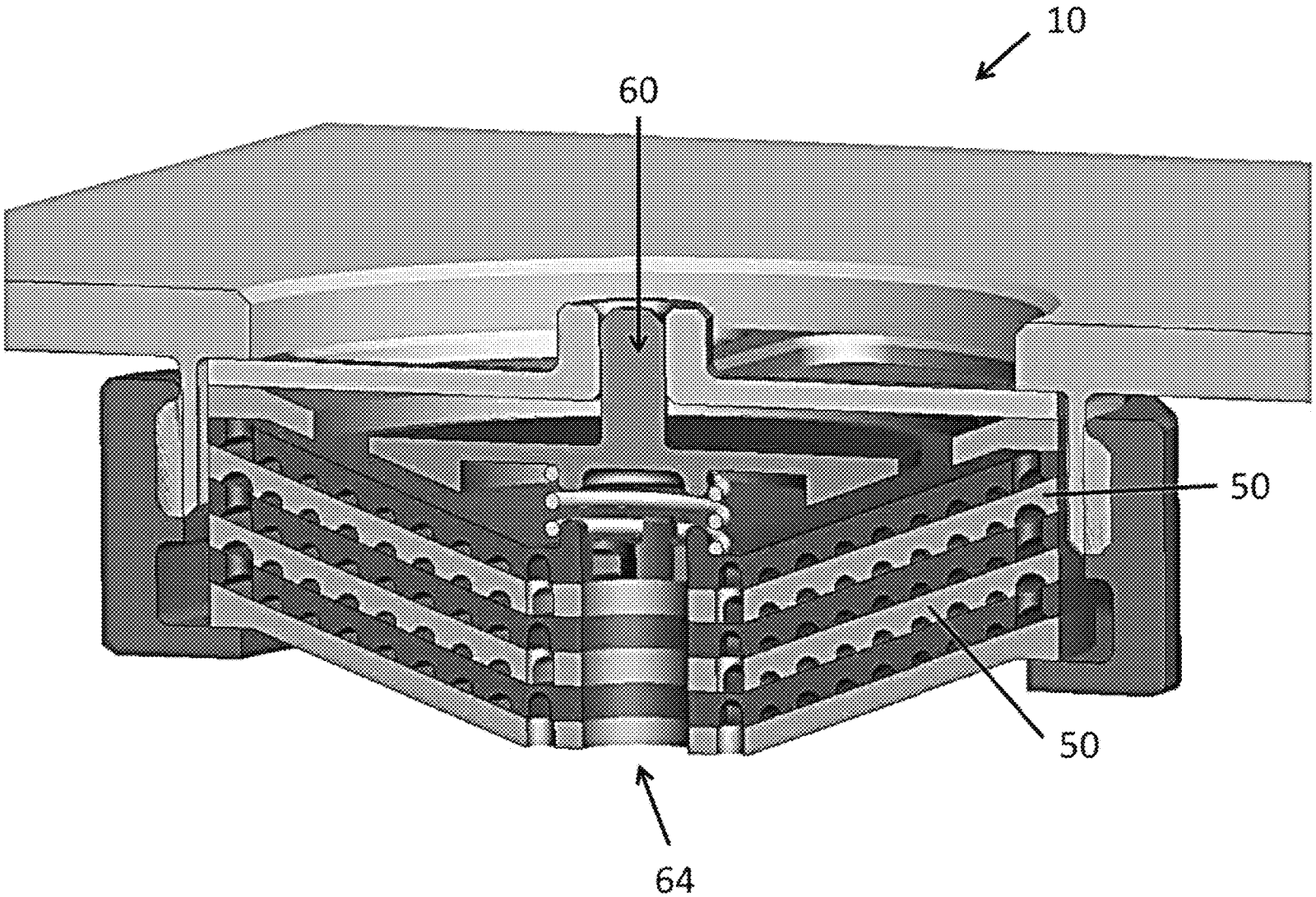
FIG. 11B is side cross-sectional view of the flame arrestor generally illustrated in FIG. 11A.

FIG. 11A generally illustrates a portion of another embodiment of a flame arrestor 10 according to aspects of the present disclosure. FIG. 11B generally depicts a cross-sectional view of the flame arrestor 10 shown in FIG. 11A. For example and without limitation, the illustrated embodiment of the flame arrestor 10 shown in FIGS. 11A and 11B may be referred to as a "multiple-stage flame arrestor" that employs a "conic helical path concept with an input drain self-shutting valve." That is, this particular embodiment may employ a conic flame path configuration (which may be similar to that associated with the embodiment of FIGS. 9A and 9B) and may include a valve, e.g., an input drain self-shutting valve 60. In the illustrated embodiment, the flame arrestor 10 is shown without venting, and the input drain self-shutting valve 60 is shown provided toward the top side/portion of the flame arrestor prior to the modules. With the embodiment, condensation can be trapped and permitted to come out. However, in the event of an explosion, the valve can be configured to shut or shut-off flow. With embodiments, an associated drain hole (e.g., drain hole 64) may be fairly large, comparatively, to allow water or condensation to exit. In an embodiment, the drain hole 64 may, for example and without limitation, have a 0.25 inch minimum diameter. It is noted that valves may be associated with planar or cylindrical flame arrestor concepts.

With embodiments in which the flame path is permanently opened, a flame arrestor may assure venting capability. In such cases, the flame arrestor may be referred to as a flame arrestor with ventilation. In other embodiments, if and when venting capability is not needed, the flame arrestor may be coupled with a normally shut valve, and the normally shut valve may be configured to prevent the associated enclosure from ventilation. In this case, the flame arrestor may be referred to as a flame arrestor without ventilation. Additionally, embodiments of a disclosed flame arrestor may be used with a self-shutting valve (e.g., a valve which may be configured to close under pressure from an explosion of a gas). In such a case, the device may be referred to as a flame arrestor with a drain. In embodiments, a drain valve may be included on an input side of a drain hole (see, e.g., FIG. 11B), or on an output side of a drain hole (see, e.g., FIG. 12B). Moreover, with the application of a conical concept flame, such as previously described, in embodiments a single module may be configured to employ a spiral groove as a gravity-fed drain so that no valve would be needed. Additionally, embodiments of a flame arrestor may include a normally-open, self-shutting valve on both input and output ends or sides to provide additional robustness to a design. If desired, normally-open valves may be heated (e.g., by resistive electric heating/heaters) to better maintain material temperature (e.g., to maintain a temperature above a freezing point), which can help prevent ice build-up or other conditions that could affect or prevent valve closure. Such heating may also be directed to the flame path and flame path components to help prevent ice build-up and help ensure sufficient ventilation and function.

In embodiments, and with respect to venting, a small hole may be provided to allow pressure in the main enclosure to equalize. Embodiments can be inherently venting-enabling, as the arrestor may be configured such that there is always a path running from inside to outside. The configuration can serve as a breather, among other things. That is, in embodiments, it may be desirable to suppress the breathing with the valve normally closed, and to release the valve if the pressure increases.

Figure 12A:
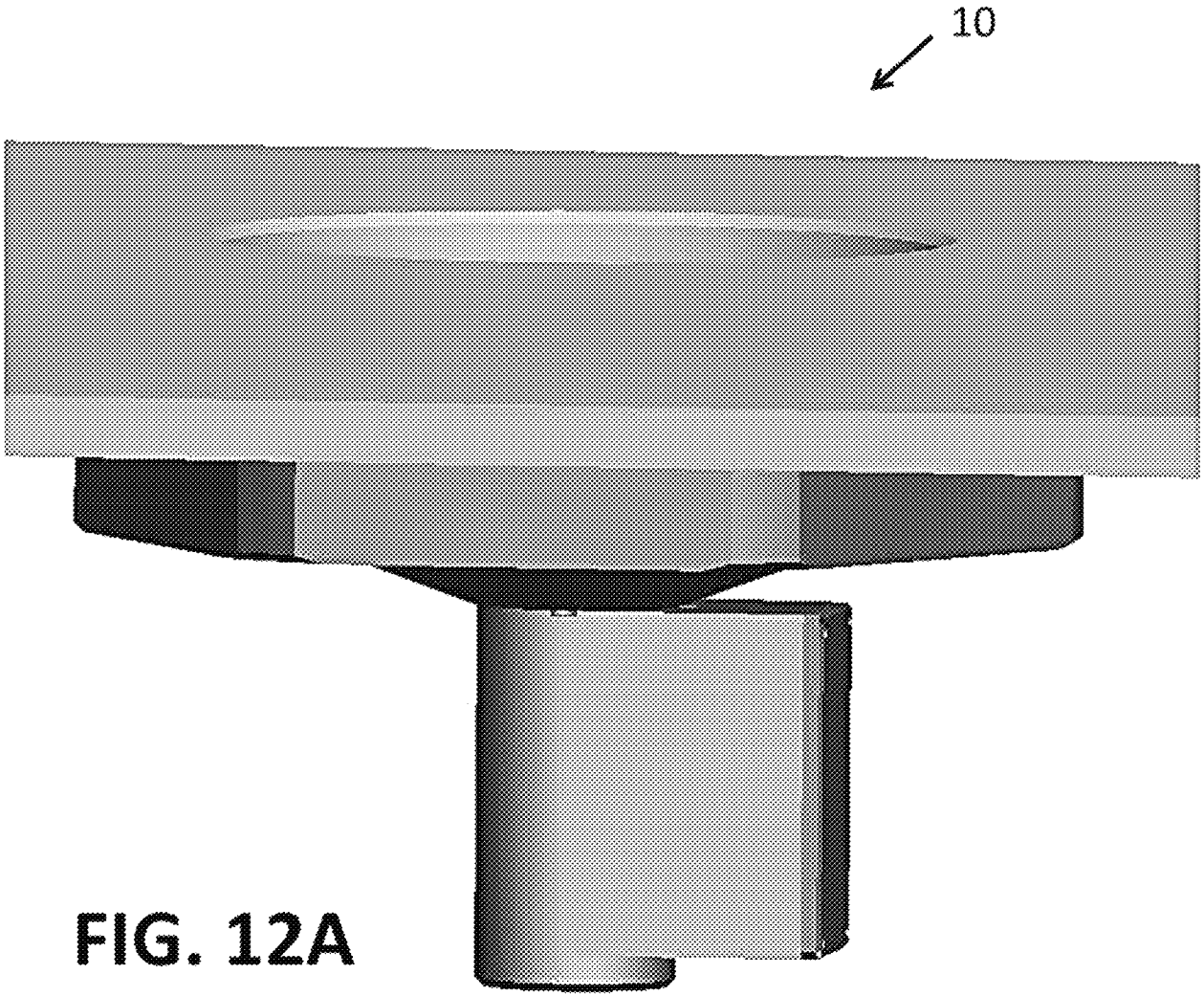
FIG. 12A is side view of a flame arrestor according to another embodiment of the present disclosure.
Figure 12B:
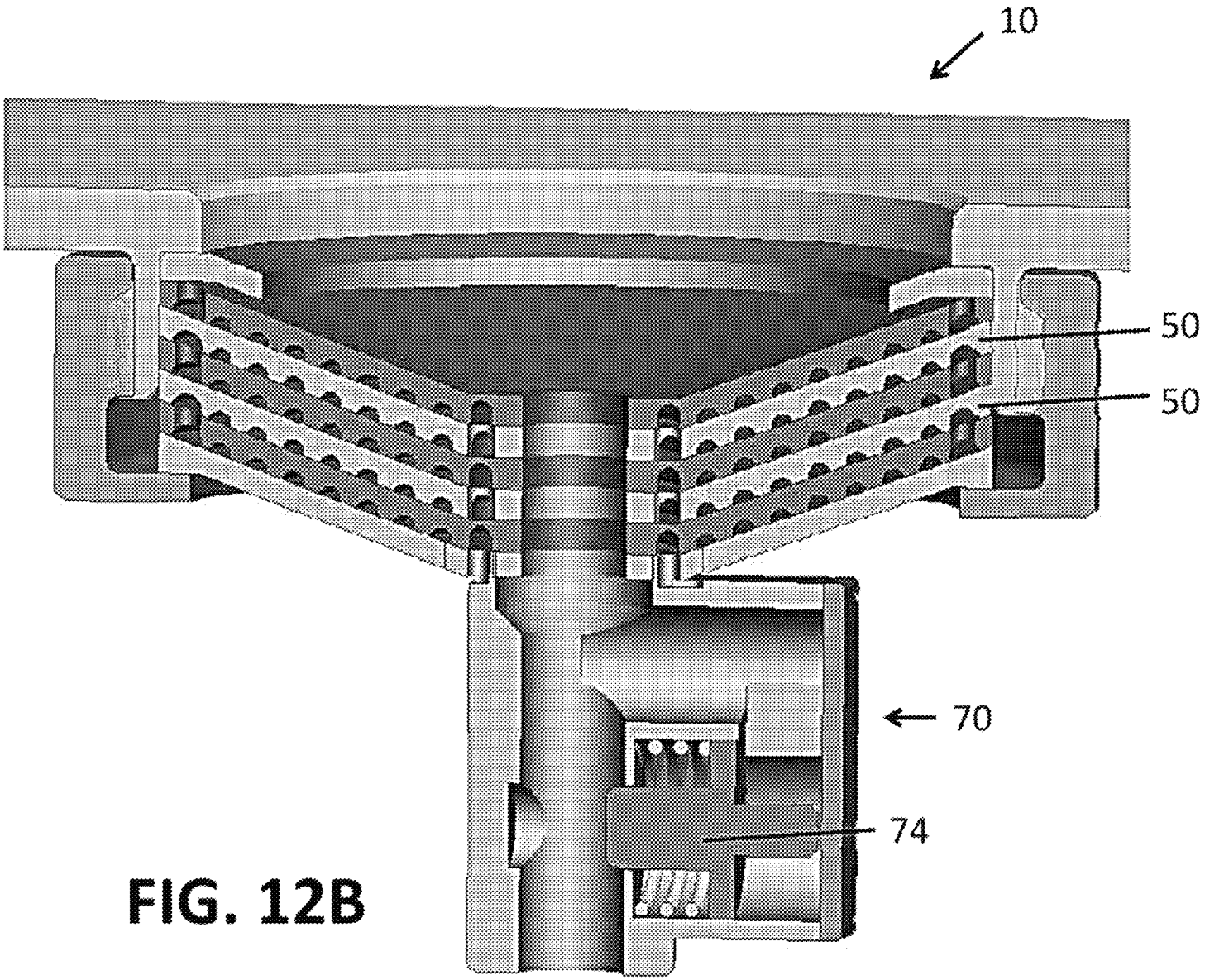
FIG. 12B is side cross-sectional view of the flame arrestor generally illustrated in FIG. 12A.

FIG. 12A generally illustrates a portion of another embodiment of a flame arrestor 10 according to aspects of the present disclosure. FIG. 12B generally depicts a cross-sectional view of the flame arrestor 10 shown in FIG. 12A. For example and without limitation, the illustrated embodiment of the flame arrestor 10 shown in FIGS. 12A and 12B may be referred to as a "multiple-stage flame arrestor" that employs a "conic helical path concept with an output drain self-shutting valve." That is, without limitation, this particular embodiment may employ a conic flame path configuration (which may be similar to that associated with the embodiment of FIGS. 9A and 9B) and may include a drain valve 70, e.g., an output drain self-shutting valve. Again, a drain valve (such as drain valve 70) may be employed with planar or cylindrical concepts as generally disclosed herein.

An embodiment such as generally illustrated in FIG. 11B can add draining capability to the system or configuration. In embodiments, a spring-type valve may be included. For example, and without limitation, as pressure builds a component 74 may move to initiate a seal, which may permit gases to release. Such a configuration may serve as a humidity/fluid deflector so, among other things, condensation will not block relevant holes. That is, embodiments can be configured so that the fluid can drain out and the gases can follow an intended path. It is noted that with embodiments, the diameter of a by-pass may have a larger cross-sectional path than a main draining hole. With some configurations with a by-pass, an explosion can push a plug and close a path, which can force hot gas through a flame arrestor flame path.

Figure 11C:
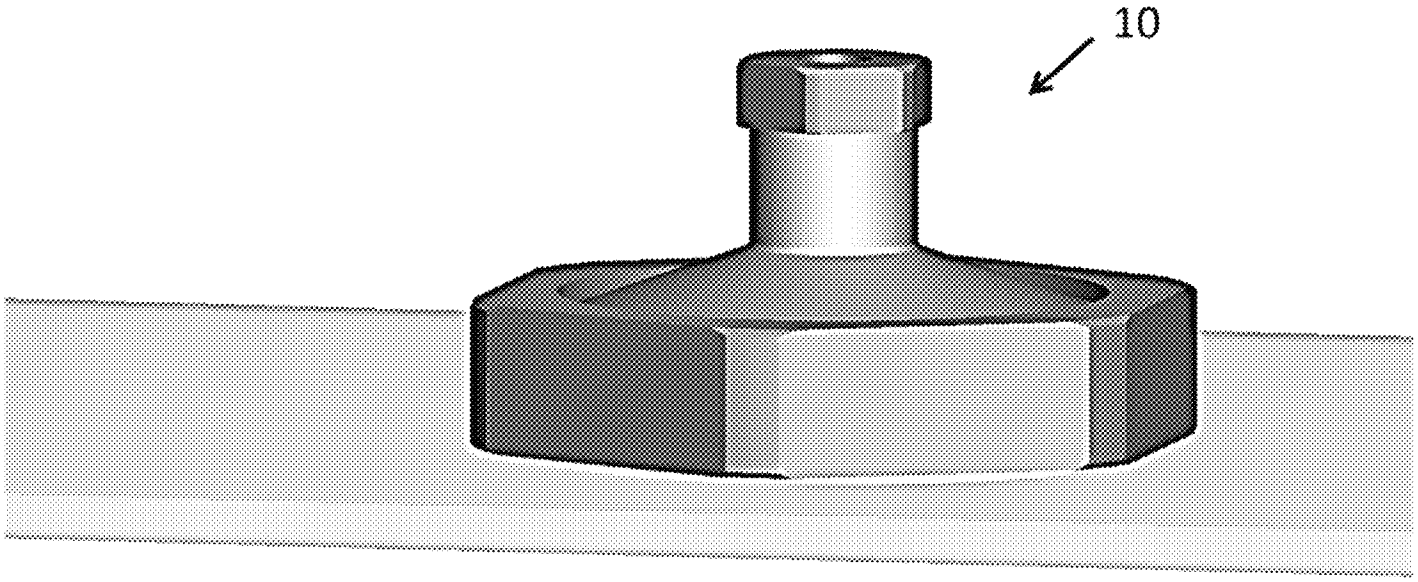
FIG. 11C is a side view of flame arrestor according to another embodiment of the present disclosure.
Figure 11D:
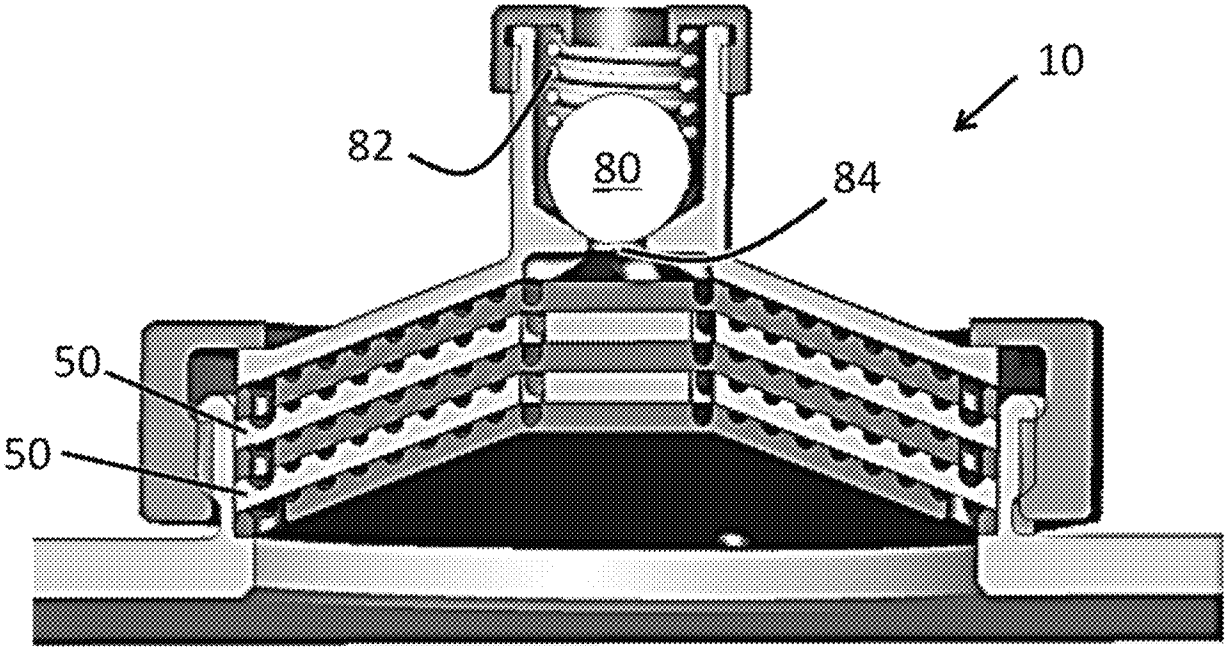
FIG. 11D is a side cross-sectional view of the flame arrestor generally illustrated in FIG. 11D.

It is noted that for some embodiments a membrane-type, or a ball-type valve, may be employed, for example, to suppress venting capability when such a function is desired. Without limitation, an embodiment of a ball-type valve implemented in the context of the present disclosure is generally illustrated in FIGS. 11C and 11D. As generally shown in the illustrated embodiment, a ball 80 may be biased by a biasing mechanism (e.g., spring 82) toward an opening 84.

The foregoing descriptions of specific embodiments of the present invention have been presented for purposes of illustration and description. They are not intended to be exhaustive or to limit the invention to the precise forms disclosed, and various modifications and variations are possible in light of the above teaching. The embodiments were chosen and described in order to explain the principles of the invention and its practical application, to thereby enable others skilled in the art to utilize the invention and various embodiments with various modifications as are suited to the particular use contemplated. It is intended that the scope of the invention be defined by the claims and their equivalents.

What is claimed:

1. A flame arrestor comprising:

a collar configured to connect the flame arrestor to a portion of an enclosure, the collar having one or more openings configured to allow gas associated with said enclosure to flow into the flame arrestor, and one or more flame paths disposed within the collar and including one or more grooves configured to transfer the gas from a first side of the one or more flame paths to a second side of the one or more flame paths; and a plug configured for connection to the collar, the plug having one or more exit apertures in communication with the second side of the one or more flame paths and configured to allow the gas to exit the flame arrestor;

wherein the plug includes a vertical path and radial paths connected thereto, wherein the gas enters the plug directly from the enclosure into the vertical path to the radial paths, and from the radial paths to the first side of the one or more flame paths, and wherein the plug has a unitary structure.

2. The flame arrestor of claim 1, wherein the collar is configured for threaded connection to the plug.

3. The flame arrestor of claim 1, wherein the one or more flame paths includes a spiral or helical flame path.

4. The flame arrestor of claim 3, wherein the spiral or helical flame path is provided within a radially expanded portion of the collar.

5. The flame arrestor of claim 1, wherein a ratio of flame path length to cross section diameter varies by portion or segment of the flame arrestor.

6. The flame arrestor of claim 1, wherein a ratio of flame path length to the cross section diameter is about 50:1 at an input portion and about 70:1 at an output portion.

7. The flame arrestor of claim 1, wherein a ratio of flame path length to the cross section diameter is about 200:1 or greater.

8. The flame arrestor of claim 1, wherein the one or more flame paths includes a conic helical flame path.

9. The flame arrestor of claim 1, wherein the one or more flame paths includes a cylindrical helical flame path.

10. The flame arrestor of claim 1, comprising a plurality of flame path modules or stages.

11. The flame arrestor of claim 10, wherein one or more of the plurality of flame path modules or stages includes an aperture configured to transfer gas to another module or stage.

12. The flame arrestor of claim 10, wherein the plurality of flame path modules or stages comprise a plurality of plates.

13. The flame arrestor of claim 10, wherein the plurality of flame path modules or stages comprise a plurality of cylinders.

14. The flame arrestor of claim 1, including a drain valve.

15. The flame arrestor of claim 14, wherein the valve comprises a normally-open, self-shutting valve, a spring-type valve, or a ball-type valve.

16. The flame arrestor of claim 1, including a drain hole.

17. The flame arrestor of claim 1, wherein the collar includes a plurality of threads configured for connection to a portion of said enclosure.

18. The flame arrestor of claim 1, including an input valve disposed on a top portion of the flame arrestor and configured to control gas flow into the flame arrestor.

19. The flame arrestor of claim 18, wherein the input valve is self-shutting.

20. A flame arrestor comprising:

a collar configured to connect the flame arrestor to a portion of an enclosure, the collar having one or more openings configured to allow gas associated with said enclosure to flow into the flame arrestor, and one or more flame paths disposed within the collar and including one or more grooves configured to transfer the gas from a first side of the one or more flame paths to a second side of the one or more flame paths; and a plug configured for connection to the collar, the plug having one or more exit apertures in communication with the second side of the one or more flame paths and configured to allow the gas to exit the flame arrestor, the plug extending the entire longitudinal length of the collar.

* * * * *